US006028501A

United States Patent [19]

Okamoto et al.

[11] Patent Number: 6,028,501

[45] Date of Patent: Feb. 22, 2000

[54] IGNITION COIL HAVING A TOROIDAL MAGNET

[75] Inventors: Noriya Okamoto; Shinichi Amano, both of Yokkaichi, Japan

[73] Assignee: Sumitomo Wiring Systems, Ltd., Japan

[21] Appl. No.: 09/128,325

[22] Filed: Aug. 3, 1998

[30] Foreign Application Priority Data

Aug. 7, 1997 [JP] Japan ..... 9-213330
Aug. 8, 1997 [JP] Japan ..... 9-214609

[51] Int. Cl.[7] ..... H01F 21/00; H01F 27/02; F02P 11/00

[52] U.S. Cl. ..... 336/110; 336/107; 336/96; 123/634

[58] Field of Search ..... 336/110, 107, 336/90, 96; 123/634, 635

[56] References Cited

U.S. PATENT DOCUMENTS

| | | | |
|---|---|---|---|
| 4,004,560 | 1/1977 | Brungsberg | 123/148 E |
| 4,459,967 | 7/1984 | Hayashi | 123/634 |
| 4,990,881 | 2/1991 | Ooyabu | 336/110 |
| 5,101,803 | 4/1992 | Nakamura et al. | 123/634 |
| 5,146,906 | 9/1992 | Agatsuma | 123/634 |

FOREIGN PATENT DOCUMENTS

| | | |
|---|---|---|
| 0431322 | 12/1991 | European Pat. Off. . |
| 8213259 | 8/1996 | Japan . |

*Primary Examiner*—Michael L. Gellner
*Assistant Examiner*—Anh Mai
*Attorney, Agent, or Firm*—Jordan B. Bierman; Bierman, Muserlian and Lucas

[57] ABSTRACT

An ignition coil, particularly for use in connection with an internal combustion engine, wherein a toroidal permanent magnet is located at one end thereof between the magnetic core and the outer cylinder. This magnet provides a reverse bias magnetic field which interacts with the field generated by the primary coil to produce a composite magnetic field which increases the efficiency of the ignition coil. The reverse bias magnetic field acts in the opposite direction from the magnetic field generated by the primary coil. In another embodiment of the coil, a support is provided in which the toroidal magnet is placed. The support may have an open top or open sides. In the former case, the complete magnet is pressed into the support and retained by gripping portions. In the latter case, the magnet is composed of at least two members, each of which is pressed into the magnet holding chamber formed by the support. Gripping portions retain the members in position.

9 Claims, 15 Drawing Sheets

IGNITION COIL HAVING A TOROIDAL MAGNET

This Application claims the benefit of the priority of Japanese Applications 9-213330 and 9-214609, filed Aug. 7, 1997 and Aug. 8, 1997, respectively.

The present Invention is directed to an ignition coil, especially for use in connection with internal combustion engines; more specifically, it concerns an ignition coil of the independent ignition type primarily for insertion into a plug hole of an internal combustion engine.

BACKGROUND OF THE INVENTION

Japanese Laid-Open Patent Publication 8-213259 describes a conventional ignition coil that is inserted into a plug hole of an automobile engine. Referring to FIG. 10 hereof, an open magnetic circuit is formed by primary coil 3 and secondary coil 5 disposed around rod-shaped magnetic core 1. This provides a structure which is compact and that has a small diameter. Also, magnetic leakage is prevented by disposing outer cylinder 9 around the external surface of transformer 7.

Furthermore, in this ignition coil, plate-shaped magnet 11 is disposed at one end or both ends of magnetic core 1 to provide reverse bias for magnetic field B1 generated by primary coil 3. The magnetic flux density in magnetic core 1, which has been magnetized by primary coil 3, is decreased by magnet 11. The coercive force from magnet 11 serves to decrease the residual field in magnetic core 1 brought on by magnetic field B1. When a direct current voltage is intermittently applied to primary coil 3, the changes in the flux density in magnetic core 1 are increased, thus providing more efficient energy retrieval at secondary coil 5.

In the ignition coil described above, outer cylinder 9 supplements magnetic core 1. However, because the magnetic circuit between magnetic core 1 and outer cylinder 9 is interrupted, the actual magnetic leakage is high. This prevents the efficient use of magnetic field B1 generated at primary coil 3 and makes the retrieval of energy less efficient.

Magnetic field B1 is generated at an end of magnetic core 1 by primary coil 3. A large proportion of the field from the end of magnetic core 1 to the end of outer cylinder 9 extends along the direction perpendicular to the axis of magnetic core 1, as shown in FIG. 10. In the ignition coil described above, magnetic field A1 generated by magnet member 11 is formed along the thickness of magnet 11, i.e. along the axis of magnetic core 1. Thus, magnetic field B1, generated by primary coil 3 between magnetic core 1 and outer cylinder 9, is not weakened by magnet 11. Instead, magnetic field B1 is formed between magnetic core 1 and outer cylinder 9 in such a matter that it is diverted around magnet 11. As a result, reverse-bias magnetic field A1 from magnet 11 cannot act efficiently against magnetic field B1 of primary coil 3. This also prevents the secondary output from increasing. FIG. 11 shows composite magnetic field C1 formed by magnetic field B1 generated by primary coil 3 and magnetic field A1 from magnet 11. In the figure, composite magnetic field C1 avoids magnet 11 without being weakened.

In Japanese Laid-Open Patent Publication 3-154311, there is described an ignition coil which uses a toroidal permanent magnet for reverse-biasing. In this ignition coil, a ring-shaped core is inserted between a rod-shaped magnetic core and a surrounding outer cylinder. A closed magnetic circuit is formed by the outer cylinder and the ring-shaped core. The toroidal magnet is inserted in the magnetic gap formed between the magnetic core and the ring-shaped core, thus providing a structure with a closed magnetic circuit. The idea behind this technology is different from that of the present Invention. Instead of using a ring-shaped core, the present Invention involves a reverse-biasing toroidal magnet inserted directly between the magnetic core and the outer cylinder, thus providing a main magnetic circuit that is open.

Also, Japanese Laid-Open Patent Publication 3-154311 does not disclose the direction of the magnetic field generated by the reverse-biasing magnet, and it is unclear how the reverse-biasing magnetic field is applied. Even if the magnet of this Publication generates magnetic field $A_1$ along the thickness of magnet member 11 (i.e. along the axis of the magnet core 8), as shown in FIG. 10, it would not be possible to obtain an appropriate reverse-biasing magnetic field as shown in FIG. 11.

Thus, magnetic field B1, which is formed by primary coil 3 between magnetic core 1 and outer cylinder 9, is not weakened by magnet 11. Instead, magnetic field B1 is formed between magnetic core 1 and outer cylinder 9 so that it is diverted around magnet 11. Thus, reverse-bias magnetic field A1 formed by magnet 11 cannot be applied effectively against magnetic field B1 of primary coil 3. This presents a problem when trying to increase the secondary output. FIG. 11 shows composite magnetic field C1 formed by magnetic field B1 (generated by primary coil 3) and magnetic field A1, generated by magnet 11. The figure shows how the path of composite magnetic field C1 is diverted around magnet 11 without being weakened.

Even if the magnet member of this publication were to generate a magnetic field along the radial direction of the magnet as in the present Invention, this ignition coil uses a closed magnetic circuit where a magnet is inserted into the magnetic gap in the narrow space between the ring-shaped core and the magnetic core. Thus, the inserted magnet member would be small and the biasing would be inadequate.

In order to overcome the problem described above, the object of the present Invention is to provide an ignition coil that uses the magnetic field generated by the primary coil effectively; applies a reverse-biasing magnetic field to the magnetic field generated by the primary coil; and allows the reverse-biasing magnet member to be easily and reliably positioned and fixed. This also makes it possible to provide a more compact ignition coil with a smaller diameter and greater efficiency in energy retrieval.

SUMMARY OF THE INVENTION

The present Invention is directed to an ignition coil comprising a transformer having a primary coil, to which direct current voltage can be intermittently applied, and a secondary coil, in which electromotive force is induced by the voltage. The transformer is disposed around the outer perimeter of a cylindrical magnetic core and spaced apart axially from one end thereof. An outer cylinder, surrounding the external surface of the transformer, extends axially substantially to an upper end at a plane passing through the one end of the core.

A toroidal permanent magnet is provided with an outer diameter which is substantially equal to either the inner or outer diameter of the outer cylinder. The inside perimeter of the toroidal magnet and the outside perimeter thereof have opposite polarities and the inside perimeter abuts the outer perimeter of the core. The toroidal magnet is located adjacent the plane and spaced apart axially from the transformer.

A first magnetic field is generated by the toroidal magnet and is opposed to a second magnetic field which is generated by the primary coil. The first magnetic field is radial in nature and directed outwardly of the toroidal magnet.

The primary coil is wound on a first bobbin and the secondary coil is wound on a second bobbin. The second bobbin extends beyond the first bobbin at a second end of the outer cylinder remote from the plane. The outside perimeter of the toroidal magnet may fit within the upper end of the outer cylinder or may extend to the outer diameter thereof and rest on the upper end so that the exterior surface of the outer cylinder and the outside perimeter of the toroidal magnet are continuous with each other.

In a modification of the Invention, the upper end of the outer cylinder is provided with a tapered surface which inclines toward the magnetic core in the direction away from the plane. The outside perimeter of the toroidal magnet is complementary to the tapered surface so that, as the magnet is placed on the core, it can be moved axially inwardly until the two surfaces are in firm contact.

In a further modification of the Invention, the toroidal magnet is made up of a plurality of magnet members which are assembled into the toroidal shape. The members are divided radially, preferably in equal parts.

In a second embodiment of the present Invention, there is a support with an outer diameter substantially equal to the inner diameter of the outer cylinder. A support inside perimeter abuts the outside perimeter of the core; the support is located adjacent the plane and, as in the previous embodiments, spaced apart axially from the transformer. It is preferred that the magnetic field be directed radially outwardly of the magnet. The arrangement of the first and second bobbins is the same as in the first embodiment of the Invention.

The support comprises a magnet holding groove which is open at the upper end. Desirably, there is at least one engagement claw, adjacent the upper end, on the inner wall of the holding groove. The engagement claw is spaced axially apart from the floor of the holding groove by a distance approximately equal to the height of the toroidal magnet. Thus, as the magnet is inserted into the holding groove, the engagement claw flexes outwardly and then back inwardly to secure the magnet in place. Preferably, there is a plurality of engagement claws spaced apart circumferentially around the holding groove.

It is also advantageous to provide at least one engagement portion depending from the support. A locking claw extends inwardly from the engagement portion and an extended portion extends outwardly from the outer perimeter of the core. Thus, as the support (preferably containing the toroidal magnet) is inserted onto the upper end of the core, the extended portion and the locking claw engage each other so as to retain the support within the outer cylinder.

In a modification of the second embodiment of the present Invention, the toroidal magnet can be made up of a plurality of magnet members. These members, each consisting of a partial torus, form toroidal magnet when assembled.

In a modification of the foregoing embodiment, there are four magnet members assembled to form the toroidal magnet. In this case, however, each of the four magnet members is spaced apart from the adjacent magnet members with the inner faces opposed to one another. Each magnet member generates a magnetic field directed radially outwardly from the center of the toroidal magnet.

Another modification of the second embodiment of the present Invention comprises a support, having a plurality of peripheral openings, each of which receives one of the magnet members. This can advantageously consist of a flat lower plate with a central hole which abuts the outer perimeter of the magnetic core. There is a flat upper plate of approximately the same diameter as the lower plate and spaced apart axially therefrom by a distance sufficient to accommodate the magnet members. A plurality of radial partitions, extending between the lower plate and the upper plate are provided, preferably at equal circumferential distances, thereby forming a plurality of holding chambers, each of which contains one of the magnet members.

A pair of slits is provided in the upper plate corresponding to each of the holding chambers, thus defining a gripping portion. There are a pair of pads adjacent the periphery of the support in each holding chamber. One of the pads projects upwardly from the lower plate and the other projects downwardly from the upper plate. In this manner, the magnet members are securely retained in the holding chambers. In a further modification of the device, the core extends beyond a plane passing through the upper end of the outer cylinder and carries engagement projections which extend radially outwardly.

Both the upper and lower plates comprising the support have a central hole, the holes being in register with each other. Protuberances are provided on the upper plate extending inwardly into the central hole. The projections and protuberances engage each other to retain the support on the core. The projections and protuberances may be continuous around the entire periphery of the core and/or the circumference of the central hole. Alternatively, they can be discontinuous so that less than the entire periphery and circumference carry them.

BRIEF DESCRIPTION OF THE DRAWINGS

In the accompanying drawings, constituting a part hereof, and in which like reference characters indicate like parts.

DETAILED DESCRIPTION OF THE INVENTION

Figure 1:
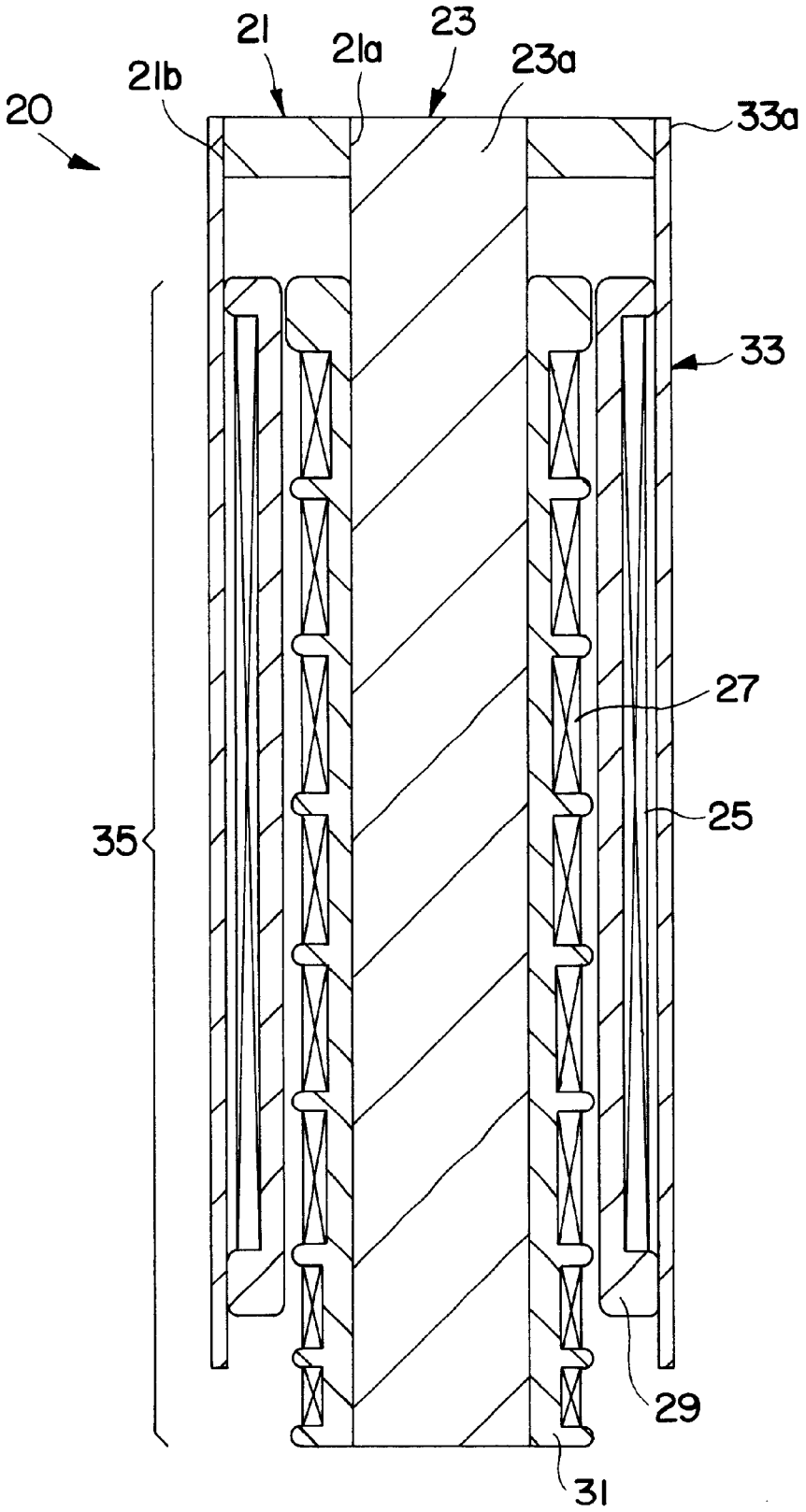
FIG. 1 is an axial sectional view of the first embodiment of the present Invention.

Ignition coil 20 comprises magnetic core 23, outer cylinder 33, transformer 35, and toroidal magnet 21. Transformer 35 includes primary coil 25 on first bobbin 29 and secondary coil 27 on second bobbin 31. Transformer 35 is located between magnetic core 23 and outer cylinder 33. Magnetic core 23 has upper end 23*a* adjacent upper end 33*a* of outer cylinder 33. Toroidal magnet 21 is located with its inside perimeter 21*a* abutting the outer periphery of magnetic core 23. Outside perimeter 21*b* of magnet 21 abuts outer cylinder 33.

Figure 2:
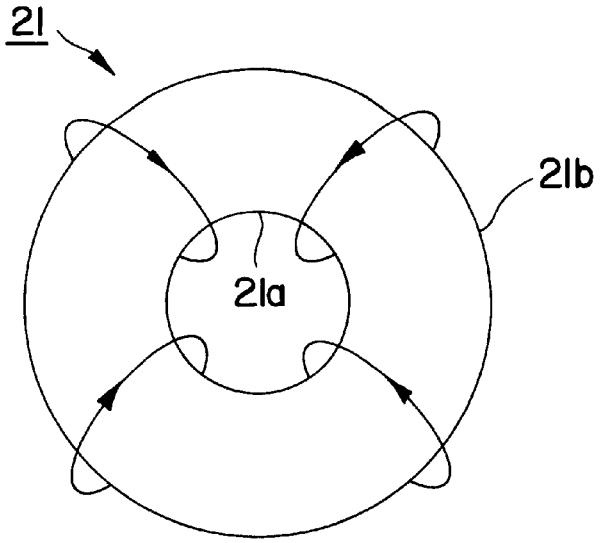
FIG. 2 is a plan view of the toroidal magnet of the present Invention.
Figure 3A:
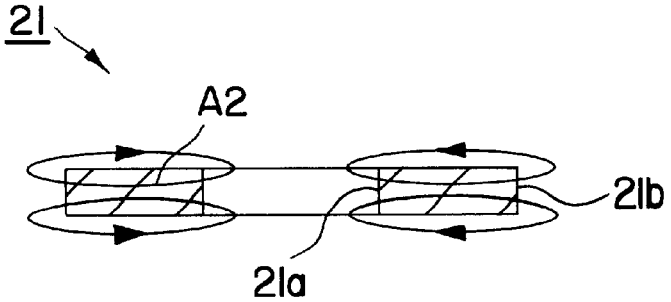
FIG. 3A is an elevation of the magnet of FIG. 2.
Figure 3B:
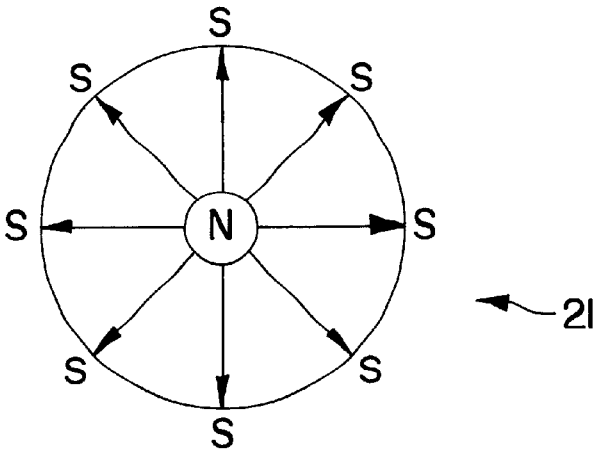
FIG. 3B is a diagrammatic plan view of the magnet showing an arrangement of polarity.
Figure 4:
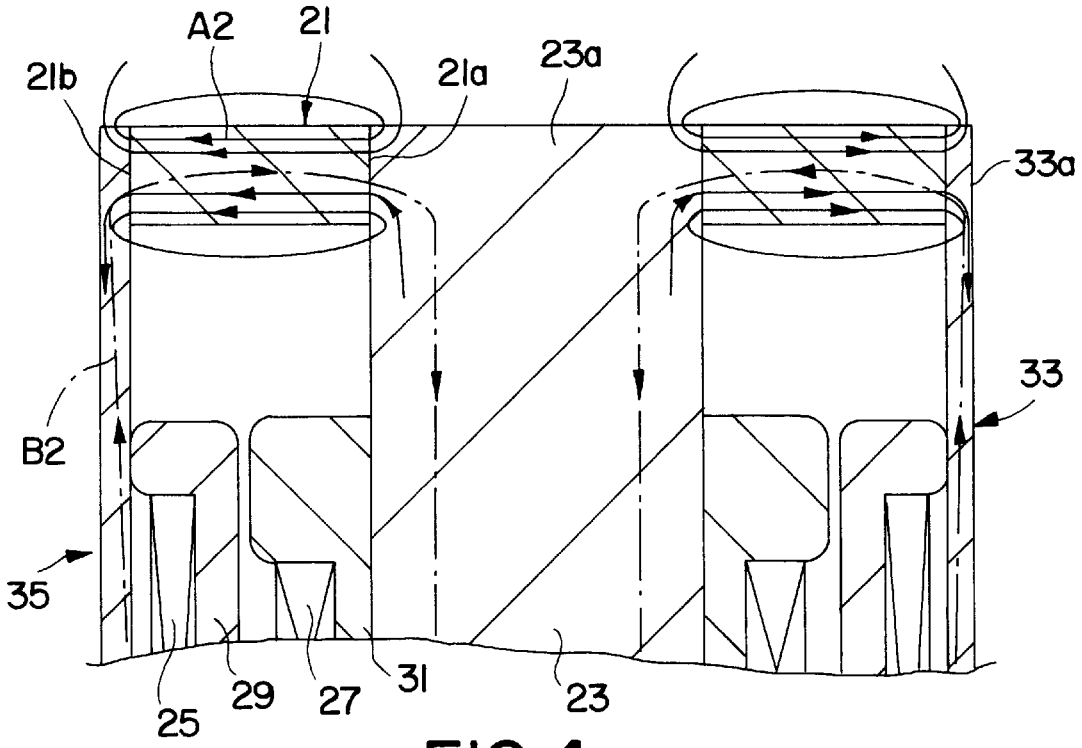
FIG. 4 is an enlarged cross-section showing the magnet and the fields generated.
Figure 5:
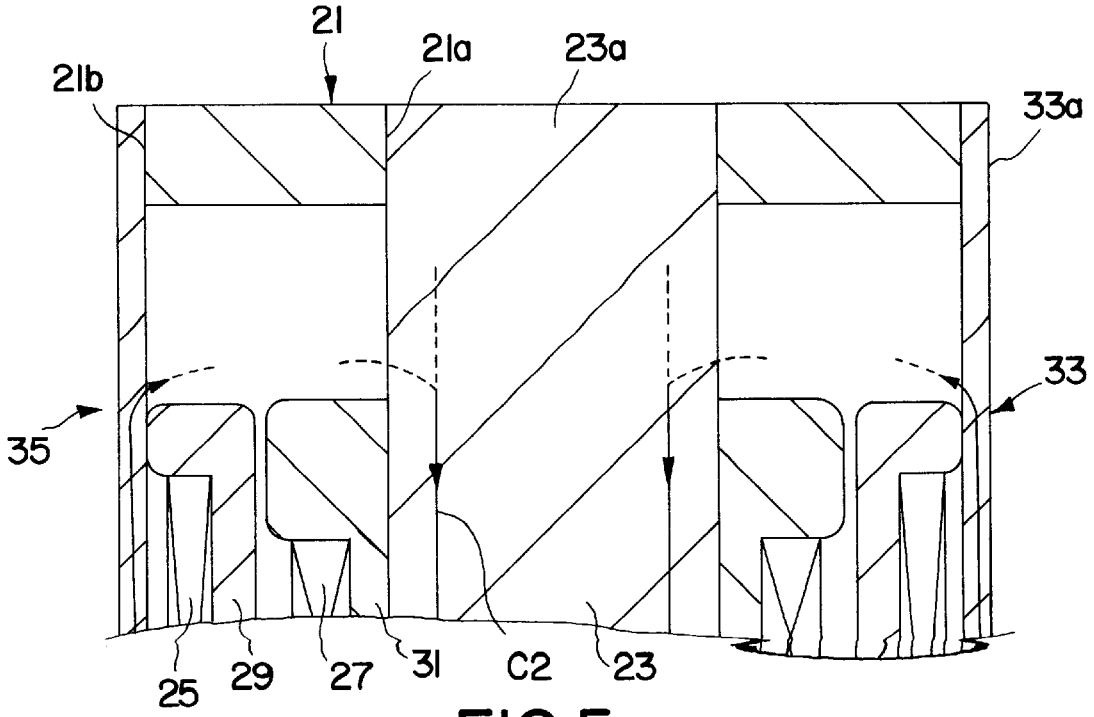
FIG. 5 is a view, similar to that of FIG. 4, showing the composite magnetic field.

Referring more specifically to FIGS. 2, 3A, and 3B, reverse bias magnetic field A2 is generated by toroidal magnet 21. The polarity is shown in FIG. 3B; the magnetic fields passing around the periphery of magnet 21 are omitted for clarity. Also, the arrows indicating the magnetic fields and polarities could be reversed. In FIGS. 4 and 5, the magnetic fields as generated by the present Invention are shown in greater detail. Reversed bias magnetic field A2 is generated by toroidal magnet 21 and magnetic field B2 is generated by primary coil 25. In FIG. 5, composite field C2, resulting from the interaction of magnetic fields A2 and B2, is shown.

Figure 6:
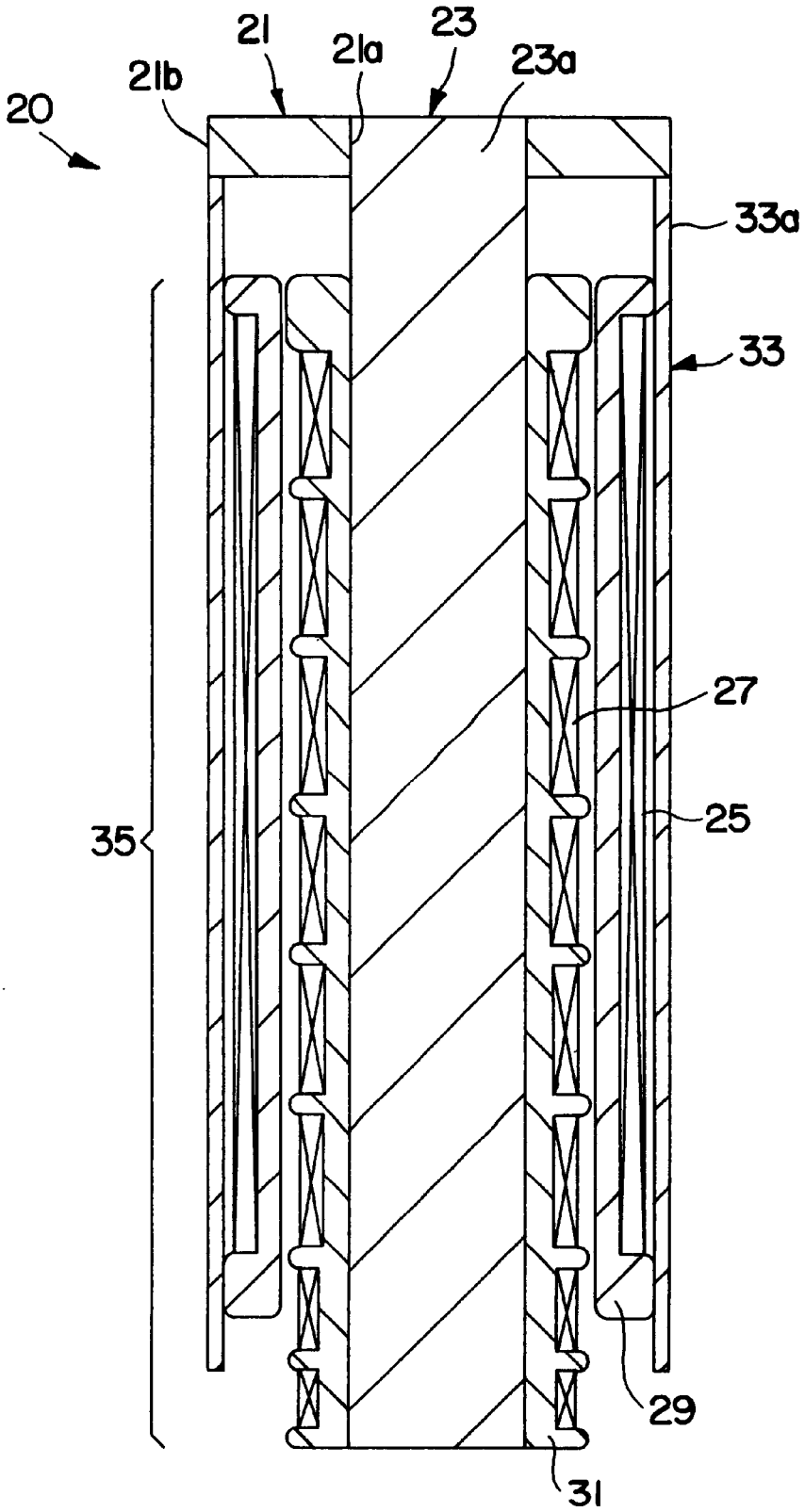
FIG. 6 is a view, similar to that of FIG. 1, of a modification of the present Invention.
Figure 7:
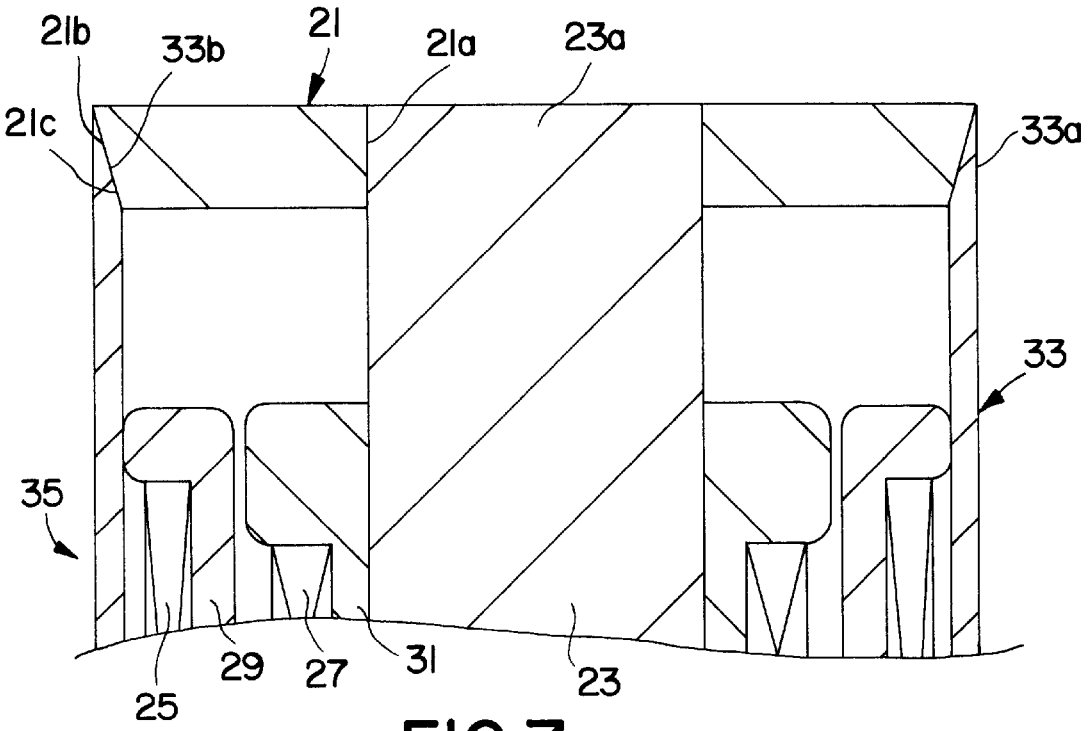
FIG. 7 is similar to FIG. 5 showing a further modification of the Invention.

Referring to FIG. 6, toroidal magnet 21 is mounted by inside perimeter 21A on core 23. However, outside perimeter 21*b* of magnet 21 rests on upper end 33*a* of outer cylinder 33. In FIG. 7, first tapered surface 33*b* is formed at upper end 33*a* of outer cylinder 33. Complementary thereto, is second tapered surface 21*c* at outside perimeter 21*b* of magnet 21.

Figure 8:
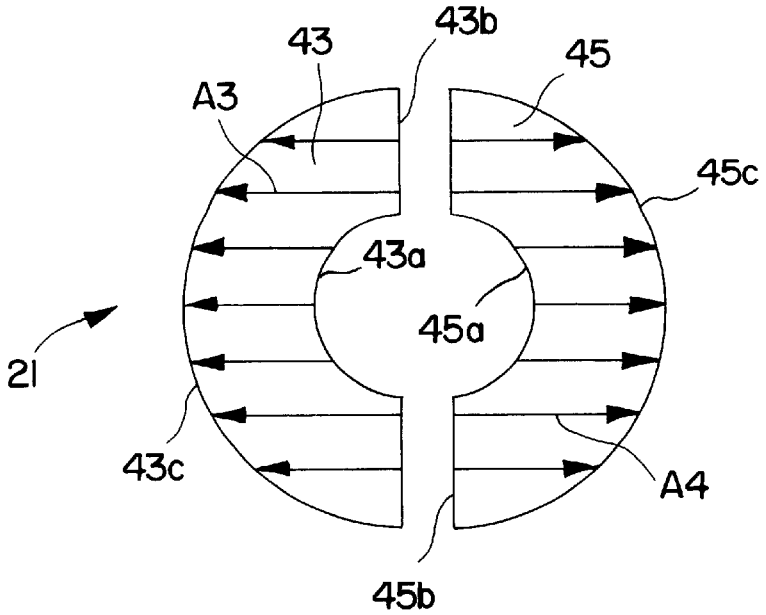
FIG. 8 is a diagrammatic plan view of the magnet made up of two magnet members.

A modification of the toroidal magnet is shown in FIG. 8. Toroidal magnet 21 consists of magnetic member 43, having inner perimeter 43*a*, first inner face 43*b*, and outer face 43*c*, and magnetic member 45, having inner perimeter 45*a*, second inner face 45*b*, and outer face 45*c*. Magnetic fields A3 and A4 are directed in accordance with the arrows.

Figure 9:
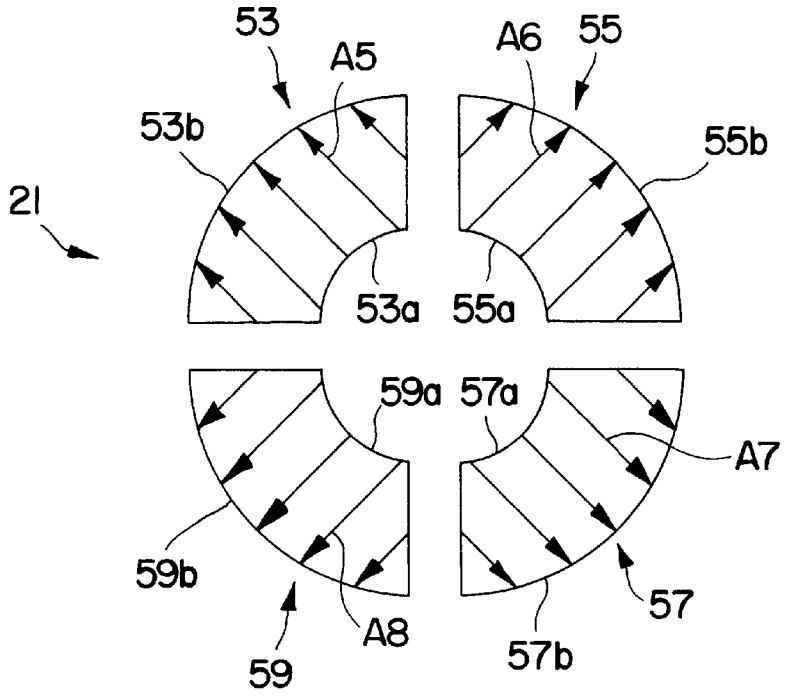
FIG. 9 is similar to FIG. 8 showing four magnet members constituting the magnet.
Figure 10:
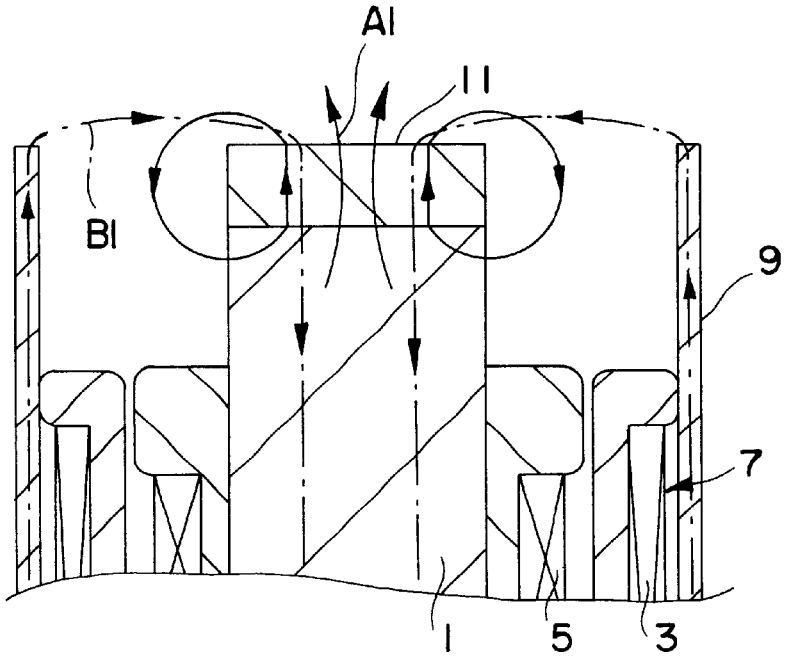
FIG. 10 PRIOR ART
FIG. 10 is a view, similar to that of FIG. 4, showing a prior art construction.
Figure 11:
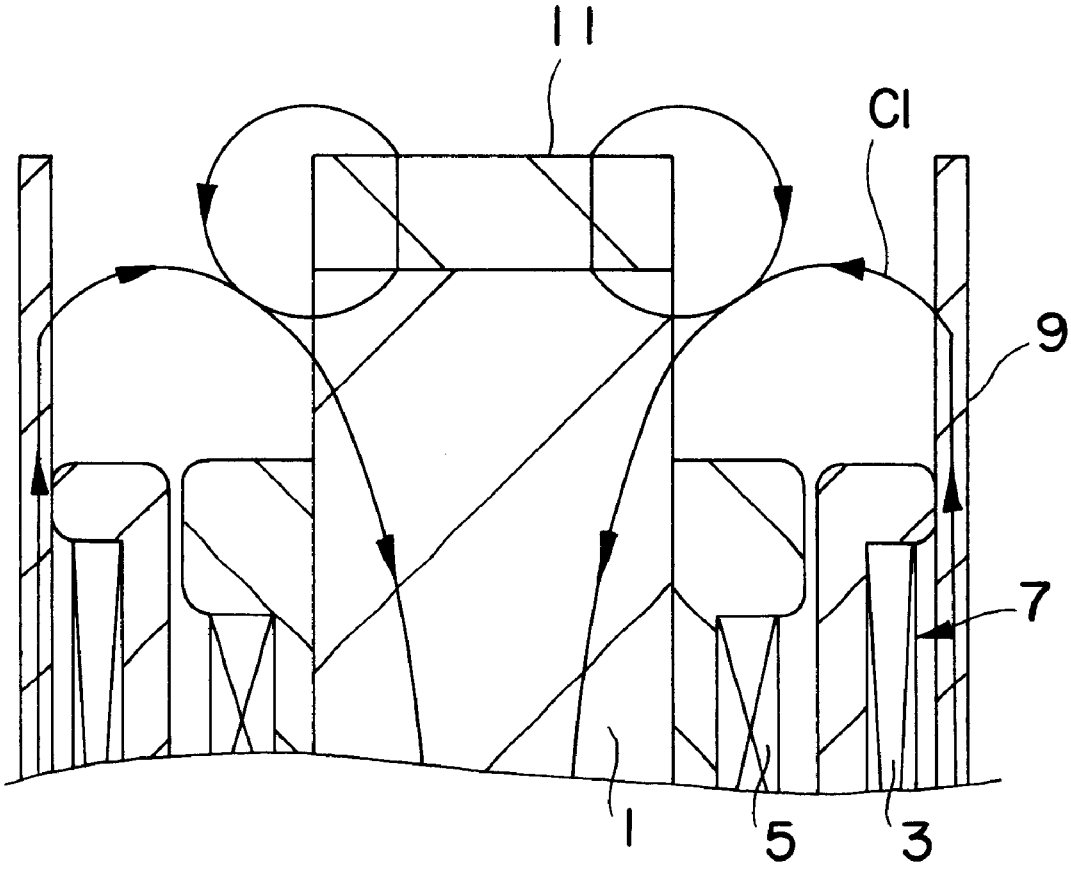
FIG. 11 PRIOR ART
FIG. 11 is similar to FIG. 10, showing prior art magnetic fields.

In FIG. 9, toroidal magnet 21 is made up of magnetic members 53, 55, 57, and 59. These members have inner perimeters 53*a*, 55*a*, 57*a*, and 59*a*, respectively. They are also provided with outer perimeters 53*b*, 55*b*, 57*b*, and 59*b*, respectively. They generate magnetic fields A5, A6, A7, and A8, respectively, in the directions indicated by the arrows. In both FIGS. 8 and 9, as in FIG. 3B, the magnetic fields passing around the periphery of toroidal magnet 21 have been omitted for clarity.

Figure 12:
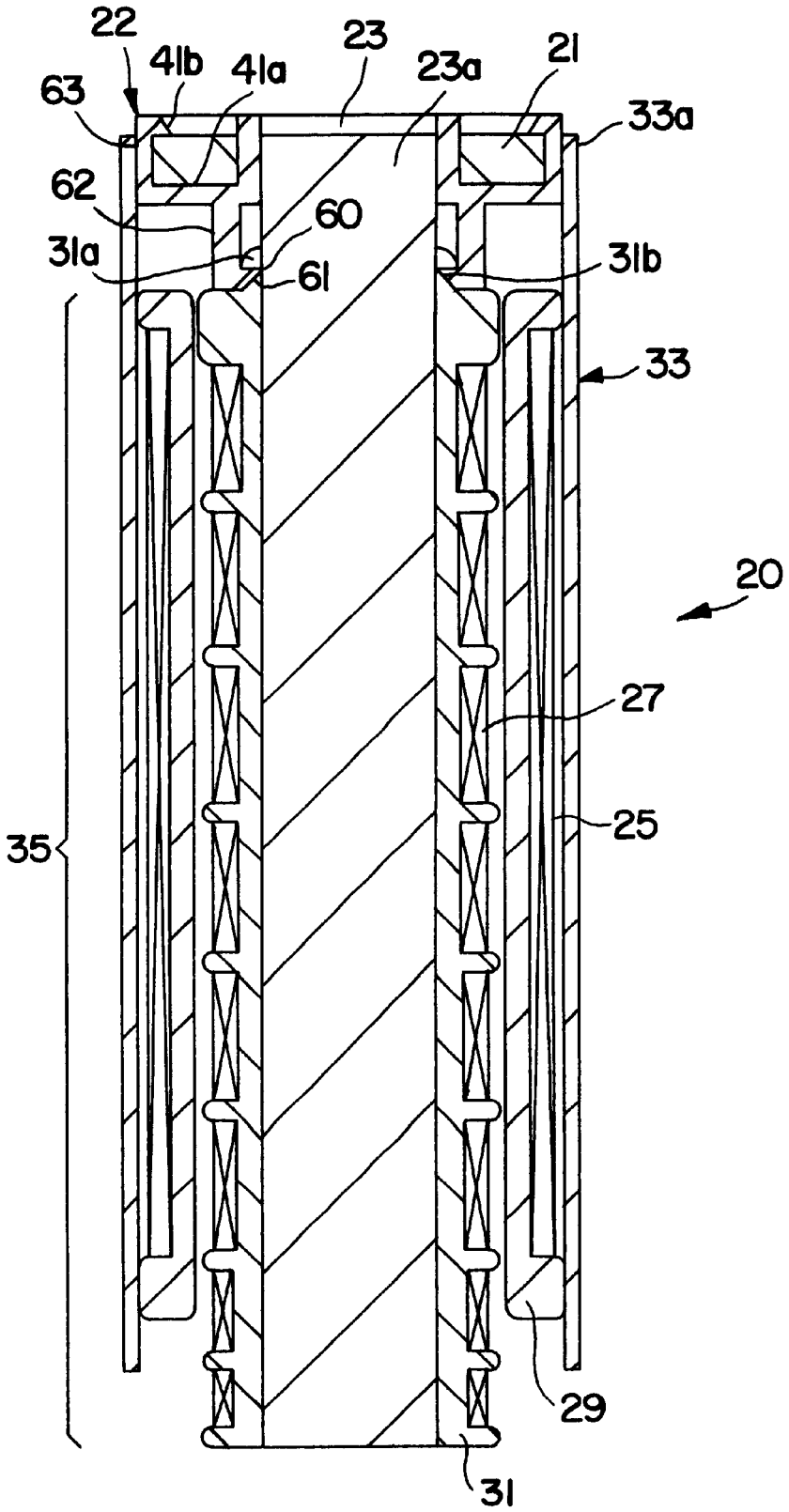
FIG. 12 is a view, similar to that of FIG. 1, showing a second embodiment of the present Invention.
Figure 13:
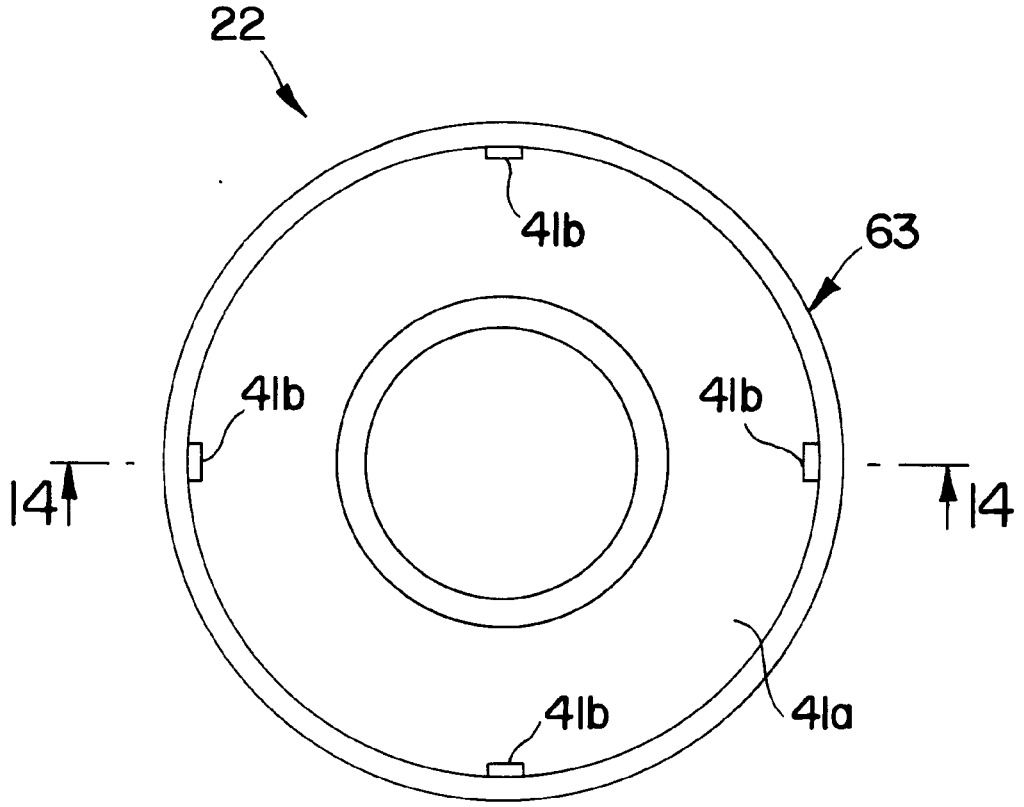
FIG. 13 is a plan view of the support of FIG. 12.
Figure 14:
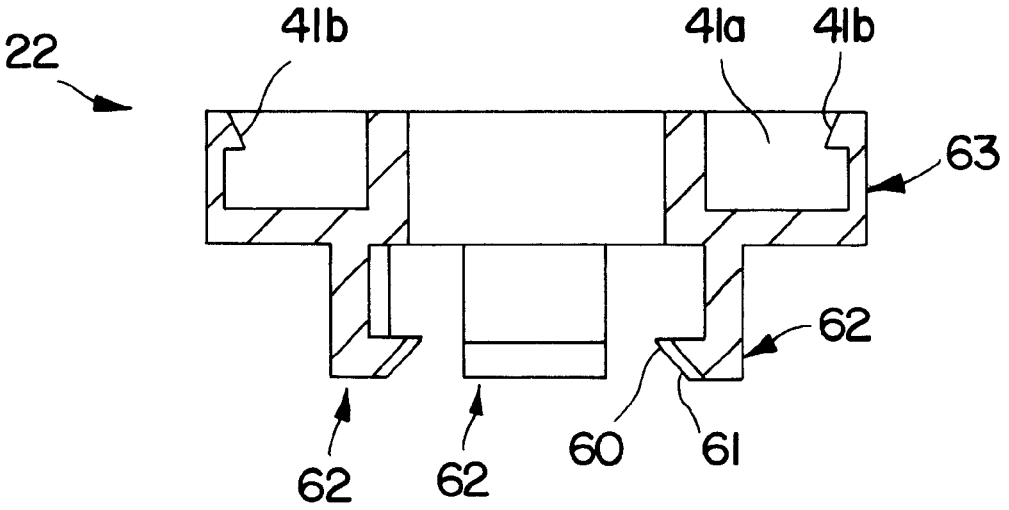
FIG. 14 is a cross-sectional elevation of the support of FIG. 13.

In a second embodiment of the present Invention (see FIGS. 12 to 14), support 22 is provided for toroidal magnet 21. Support 22 comprises magnetic holding groove 41*a* having engagement claw 41*b*. When magnet 21 is inserted into holding groove 41*a*, support portion 63 flexes outwardly to allow it to pass. Once magnet 21 is seated in groove 41*a*, support portion 63 resumes its upright position, and engagement claw 41*b* holds magnet 21 in place.

Engagement portion 62 depends from support 22 and is provided with locking claw 60 which cooperates with engagement portion 62 on magnetic core 23. As support 22, preferably containing magnet 21, is pressed onto magnetic core 23, engagement portion 62 flexes outwardly, permitting locking claw 60 to pass over extended portion 31*a* of magnetic core 23. Locking claw 60 can usefully be provided with tapered surface 61 which facilitates the movement. Once locking claw 60 has cleared extended portion 31*a*, engagement portion 62 snaps into vertical position and locks support 22 in place.

Figure 15:
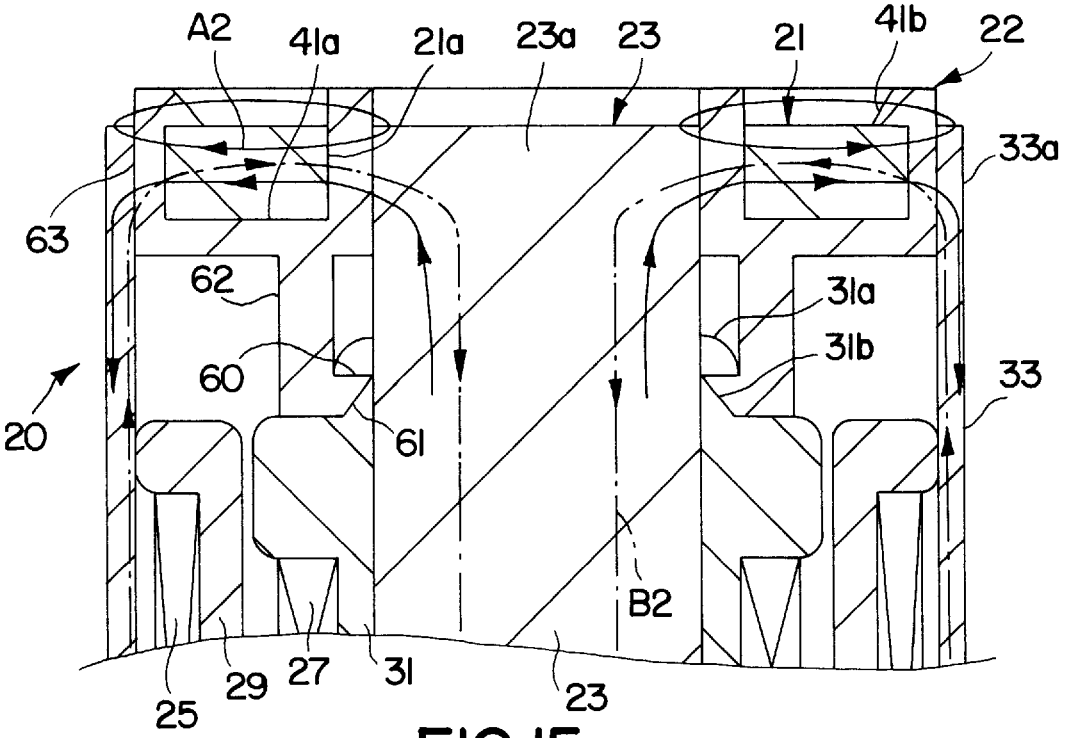
FIG. 15 is a view, similar to that of FIG. 4, of the second embodiment of the Invention, showing some of the magnetic fields generated.
Figure 16:
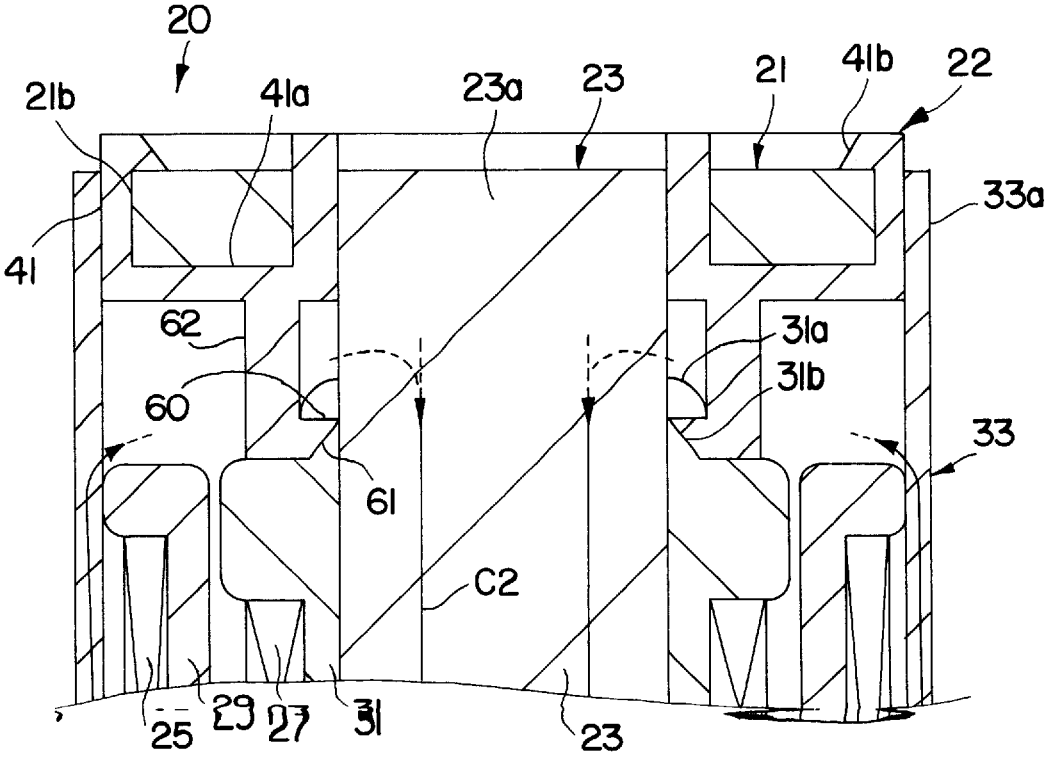
FIG. 16 is a view, similar to that of FIG. 15, showing the composite field.

With particular reference to FIGS. 15 and 16, the magnetic fields generated by this embodiment of the Invention are shown. Reverse bias magnetic field A2 is generated by toroidal magnet 21. Magnetic field B2 is formed by primary coil 25. Composite magnetic fields C2 is the resultant of fields A2 and B2.

Figure 17:
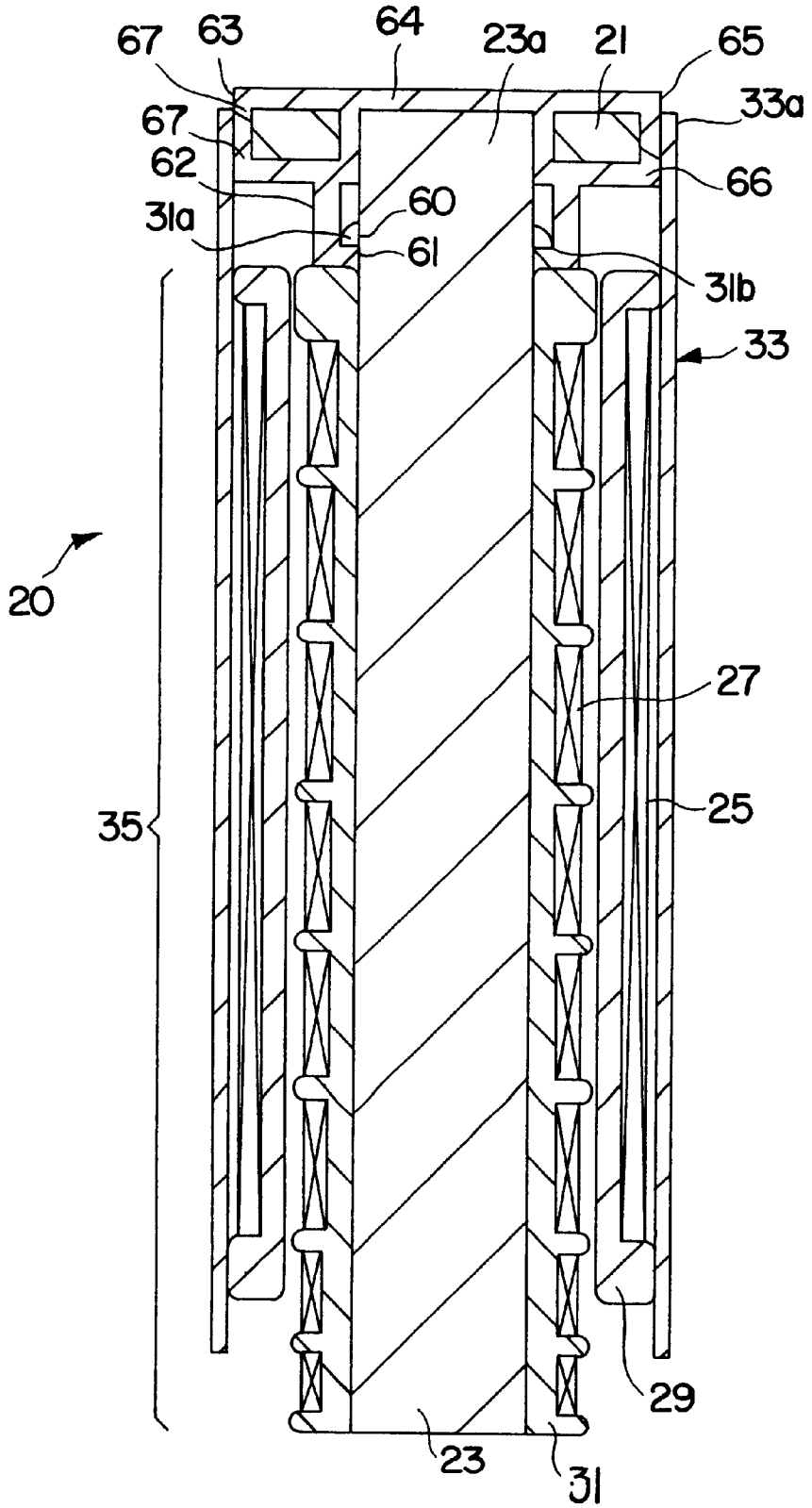
FIG. 17 is a view, similar to that of FIG. 12, showing a modification of the second embodiment.
Figure 18:
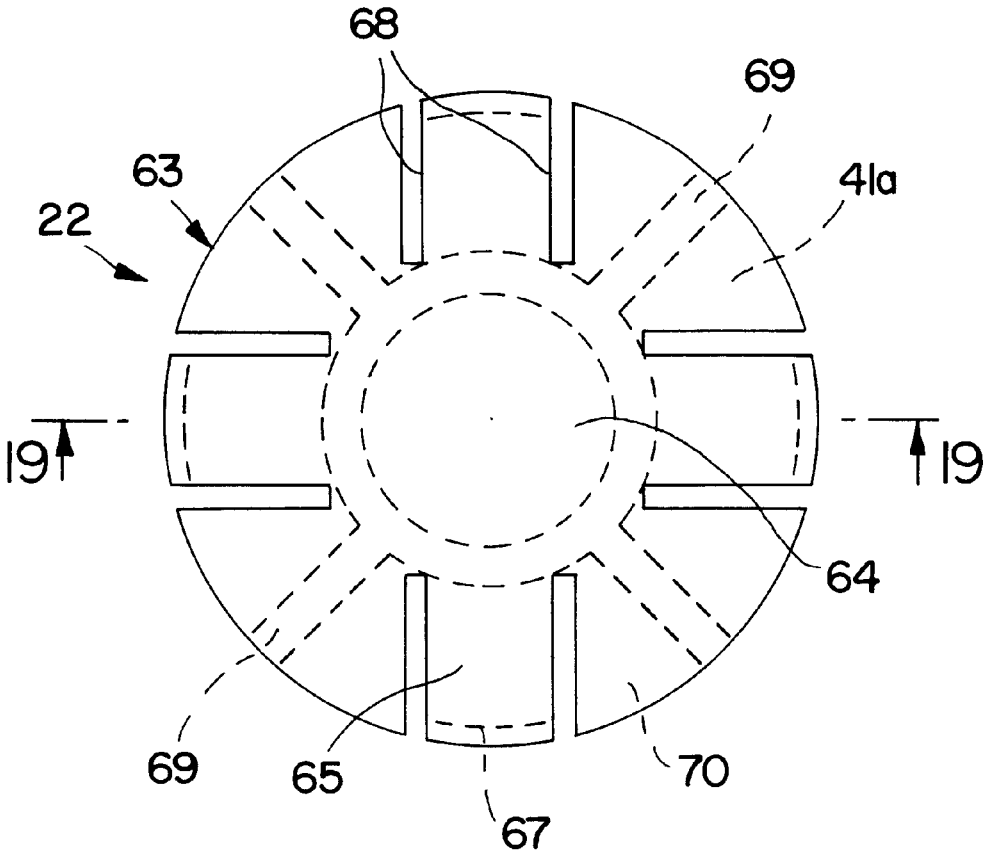
FIG. 18 is a plan view of FIG. 17.
Figure 19:
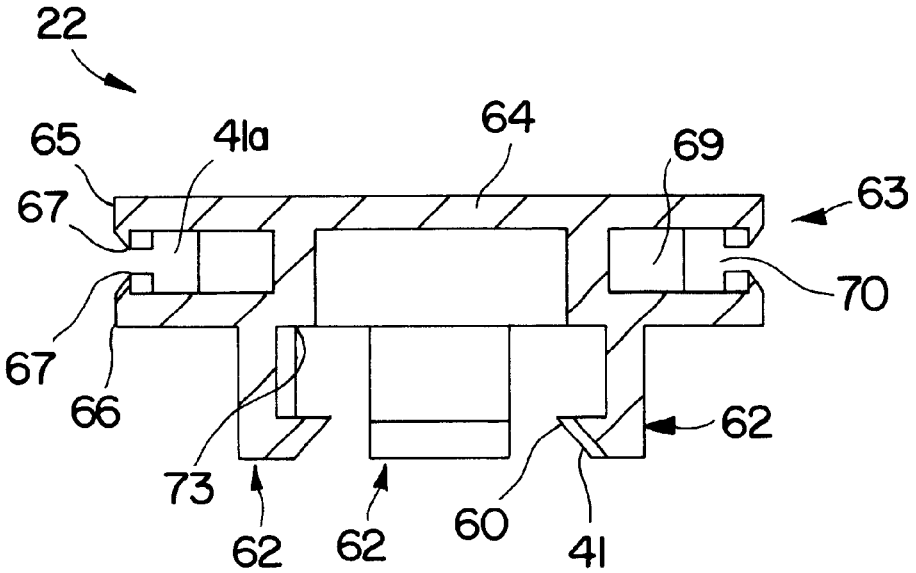
FIG. 19 is similar to FIG. 14 showing a modification of the support.
Figure 20:
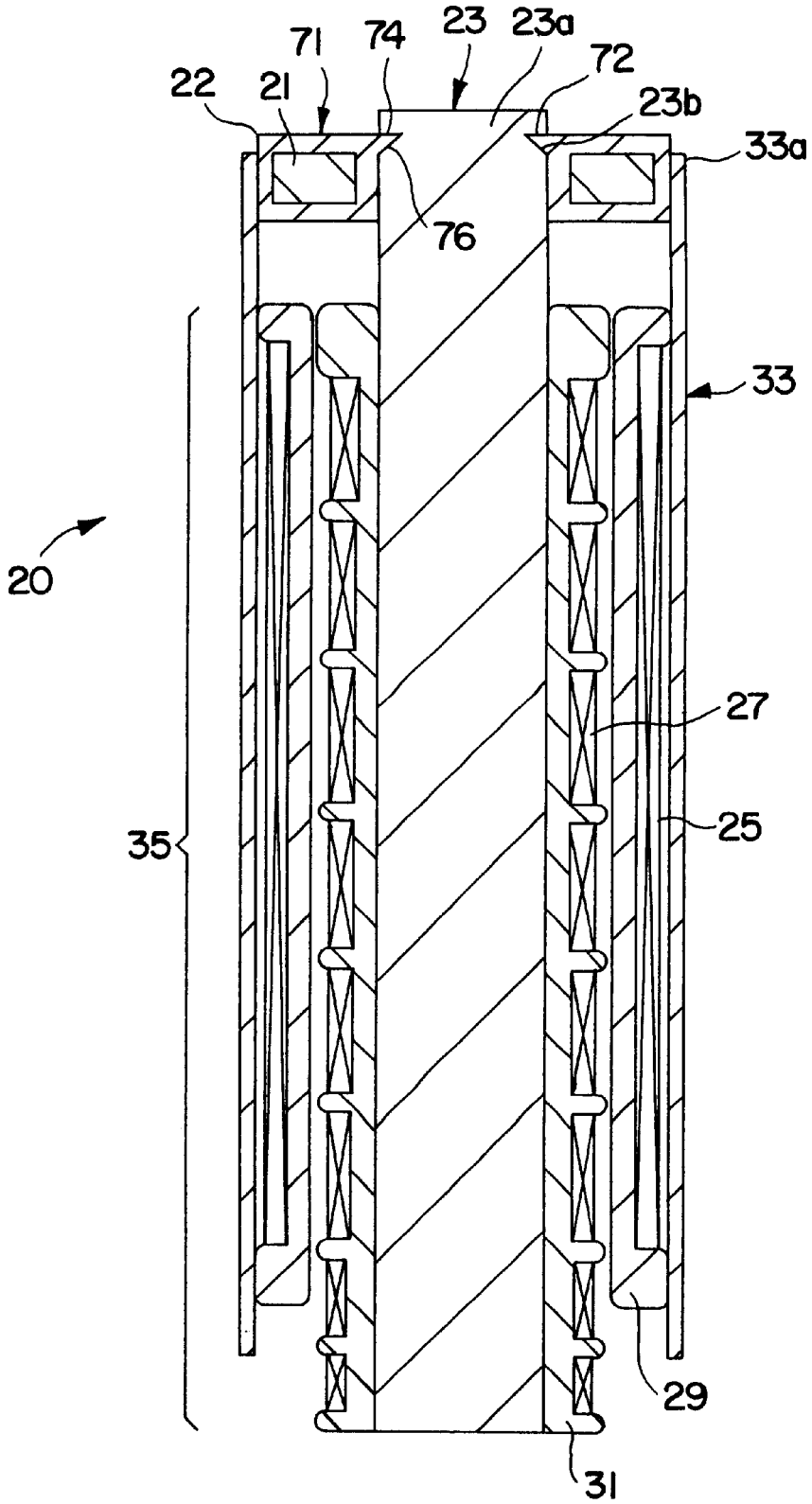
FIG. 20 is an axial cross section of a modification of FIG. 12.

FIGS. 17 to 19 represent a modification of the previously-described form of the Invention. Coil 20 includes support 22 which consists of support portion 63 made up of upper plate 64 and lower plate 73. They are divided into holding chambers 70 by partitions 69. Engagement pads 67 are provided at gripping portions 65 of holding chambers 70. In a preferred form of this modification, slits 68 are provided in upper plate 64 and/or lower plate 73, thus defining gripping portions 65 and 66. Each of the four magnet members is introduced into a corresponding holding chamber 70. Gripping portions 65 and 66 flex apart from each other as the magnet is introduced. When the magnet is fully seated in holding chamber 70, gripping portions 65 and 66 move toward each other and secure the magnet in place. Gripping sections 65 and 66, at their outer edges, are provided with tapered surfaces which assist in entry of the magnet members.

Figure 21:
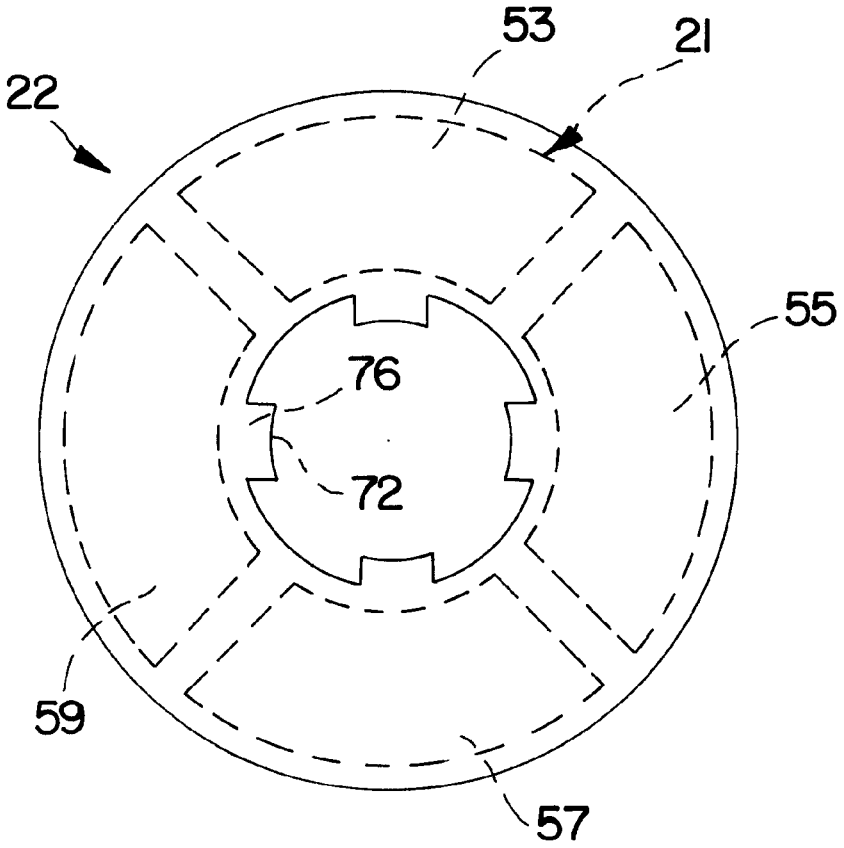
FIG. 21 is a plan view of FIG. 20.
Figure 22:
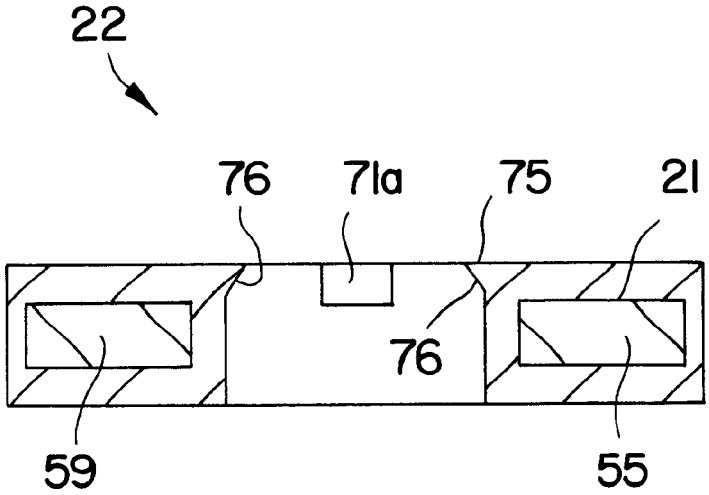
FIG. 22 is an axial cross-section of the support of FIG. 21.
Figure 23:
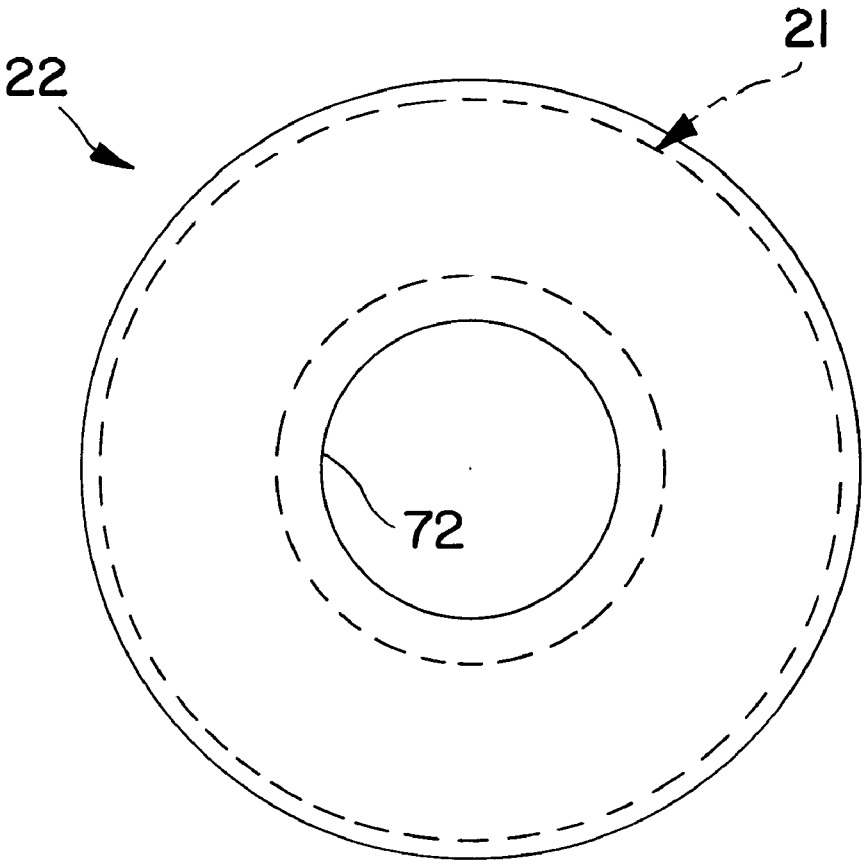
FIG. 23 is a plan view of a modification of the support of FIG. 21.
Figure 24:
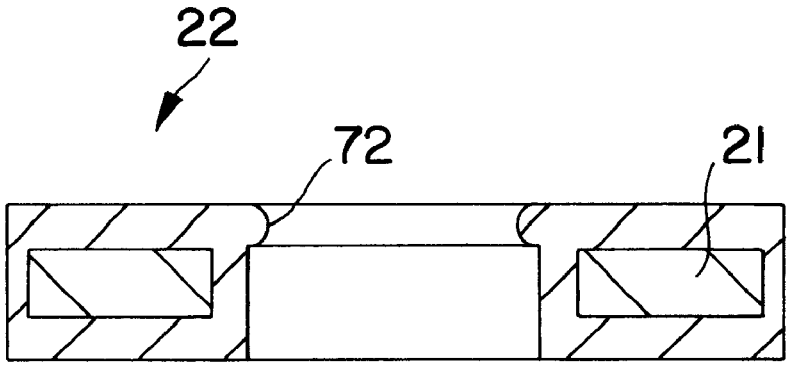
FIG. 24 is a cross-section of the support of FIG. 23.

Further modifications of the present Invention are to be found in FIGS. 20 to 24. Magnetic core 23 extends beyond upper plate 64 and is provided with engagement cavity 23*b*. Correspondingly, the upper plate carries engagement projections 72 having end surfaces 76 which enter engagement cavities 23*b* and lock support 22 in place. Referring more particularly to FIG. 21, end surfaces 76 are discontinuous around the inner perimeter of support 22. Engagement projections 72 are provided with end surfaces 76 to assist in passing over the end of magnetic core 23. In a further modification of the Invention (see FIGS. 23 and 24), engagement projection 72 is continuous around the inner perimeter of support 22 and the edges thereof are rounded to facilitate insertion of magnet 21.

Thus, the present Invention, in its various embodiments and modifications, is capable of providing an ignition coil wherein the reverse biasing magnetic field, generated by the toroidal magnet, interacts with the magnetic field generated by the primary coil. This interaction results in more efficient and effective usage of the latter. Moreover, the presence of the support permits positioning and fixing of the toroidal magnet at the desired location in a simple and reliable manner. In the case of magnet members forming the toroidal magnet, it is easy to simply push the members into the holding chambers or the groove. The appropriate portions flex apart to allow entry of the magnet members and, thereafter, close to retain them in place.

Similarly, the various engagement and locking members interact to secure the magnet and/or the support. In all cases, the toroidal magnet produces the reverse-biasing magnetic field which interacts with the field generated by the primary coil and permits maximum effective use thereof. Moreover, the assembly is extremely compact; thus, it takes up only a small space and is, therefore, more flexible in the locations in which it can be placed.

Although only a specific number of embodiments of the present Invention have been expressly disclosed, it is, nonetheless, to be broadly construed and not to be limited except by the character of the claims appended hereto.

What we claim is:

1. An ignition coil comprising a transformer having a primary coil, to which direct current voltage can be intermittently applied, and a secondary coil, in which electromotive force is induced by said voltage, said transformer disposed around an outer periphery of a cylindrical magnetic core and spaced apart axially from one end of said core, an outer cylinder surrounding an external surface of said transformer and axially extending substantially to an upper end at a plane passing through said one end;

a toroidal permanent magnet having a center and having an outer diameter substantially equal to an inner diameter of said outer cylinder or substantially equal to an outer diameter of said outer cylinder, said toroidal magnet having an inside perimeter and an outside perimeter of opposite polarities, said inside perimeter abutting said outer periphery, of the magnetic core said toroidal magnet being adjacent to said plane and spaced apart axially from said transformer, a first magnetic field, generated by said toroidal magnet, opposed to a second magnetic field generated by said primary coil.

2. The ignition coil of claim 1 wherein said first magnetic field is directed radially outwardly of said toroidal magnet.

3. The ignition coil of claim 1 wherein said primary coil is wound on a first bobbin and said secondary coil is wound on said second bobbin, said second bobbin being within said first bobbin and extending beyond said first bobbin at a second end of said outer cylinder remote from said plane.

4. The ignition coil of claim 1 wherein said upper end is provided with a first tapered surface which inclines toward said magnetic core in a direction away from said plane, said outside perimeter having a second tapered surface complementary to said first tapered surface.

5. The ignition coil of claim 1 comprising a plurality of magnet members assembled into said toroidal magnet and divided radially into equal parts.

6. The ignition coil of claim 5 wherein there are two said magnet members.

7. The ignition coil of claim 5 wherein a third magnetic field and a fourth magnetic field are generated by said first and second of said magnetic members, respectively, said third and fourth magnetic fields being directed out of said toroidal magnet.

8. The ignition coil of claim 5 wherein there are four said magnet members, each being a quarter torus and assembled circumferentially to form said toroidal magnet about said center.

9. The ignition coil of claim 1 wherein said toroidal magnet members generates a magnetic field directed radially outwardly from said center.

* * * * *